US005153961A

United States Patent [19]

Cucchetti

[11] Patent Number: 5,153,961

[45] Date of Patent: Oct. 13, 1992

[54] APPARATUS TO CLOSE, STRETCH AND NAIL THE FLANKS OF A SHOE VAMP TO A RESPECTIVE INSOLE, IN PARTICULAR IN MACHINE FOR ASSEMBLING SHOE PARTS

[75] Inventor: Celeste Cucchetti, Vigevano, Italy

[73] Assignee: Ormac, S.P.A., Italy

[21] Appl. No.: 675,694

[22] Filed: Mar. 27, 1991

[30] Foreign Application Priority Data

Apr. 3, 1990 [IT] Italy ..... 19941 A/90

[51] Int. Cl.[5] ..... A43D 21/14; A43D 75/00

[52] U.S. Cl. ..... 12/12.1; 12/13.1

[58] Field of Search ..... 12/8.6, 10.6, 11.2, 12/12.1, 13.1, 10.7

[56] References Cited

U.S. PATENT DOCUMENTS

| | | | |
|---|---|---|---|
| 2,660,740 | 12/1953 | Robinson | 12/12.1 |
| 2,754,529 | 7/1956 | Robinson | 12/12.1 |
| 3,146,474 | 9/1964 | Choice | 12/12.1 |
| 4,630,325 | 12/1986 | Bender et al. | 12/12.1 |
| 4,853,997 | 8/1989 | Giebel | 12/13.1 |
| 4,999,870 | 3/1991 | Jung | 12/12.1 |

*Primary Examiner*—Steven N. Meyers

*Attorney, Agent, or Firm*—Laff, Whitesel, Conte & Saret

[57] ABSTRACT

Acting on a column means (3) carrying a shoe (4) being worked is a fluid-operated actuator (19) longitudinally moving the shoe (4) in synchronism with two nailing hammers (37) acting on the opposite shoe flanks. Each hammer (37) is carried by an end plate (39) oscillatably mounted to a movable block (36) along a guide structure (33) for pushing the hammer (37) towards the shoe (4). The lower hammer end (37*a*) is elastically urged towards the edge of the shoe vamp (5) in order to stretch it when the hammer moves towards the shoe inside before the nail is driven in. The guide structure (33) is capable of oscillation about its own longitudinal axis and acts on the shoe insole (6) in order to transmit to the hammers (37) the variations in height and inclination encountered along the longitudinal shoe.

15 Claims, 6 Drawing Sheets

FIG5a
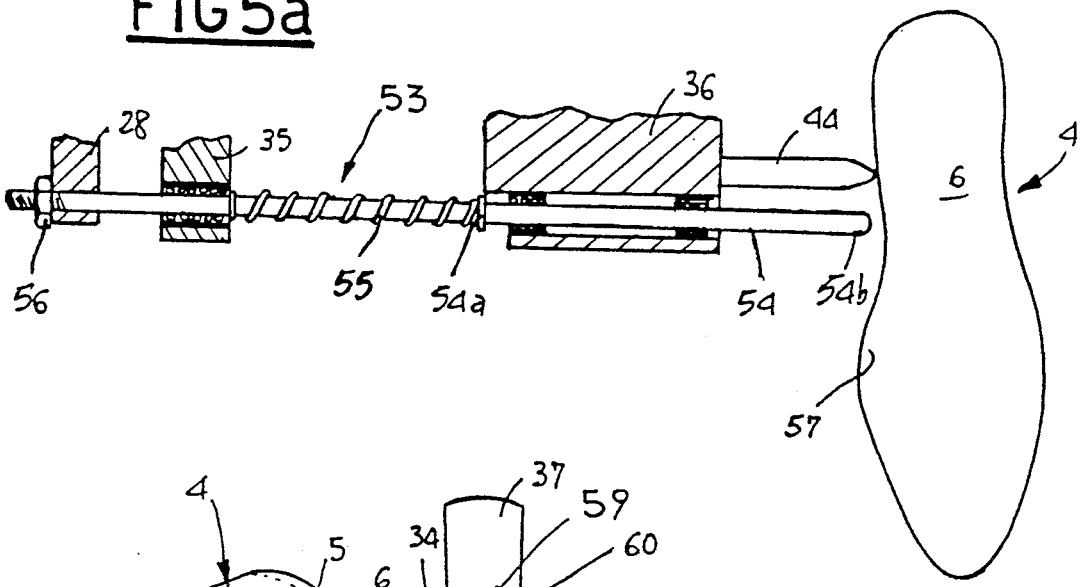
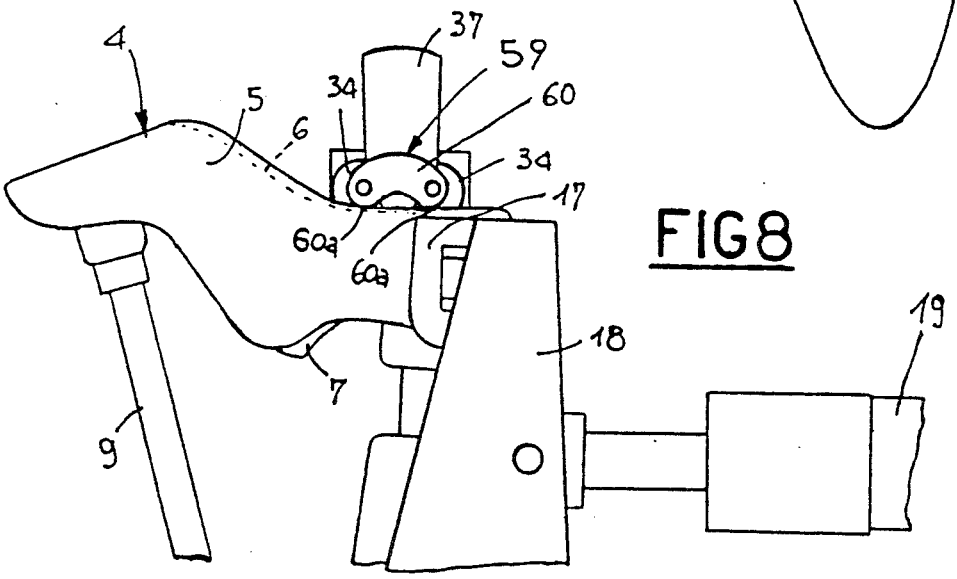
FIG8
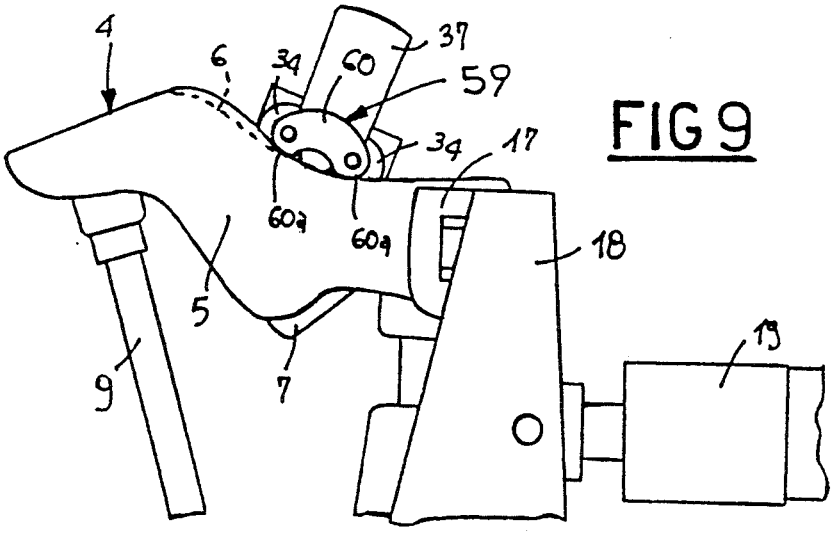
FIG9

1
20
29
38
28
27
40
39
40a
37
34
60
6
4
21
35
36
26
32
52
51
51a
50
49
47
46
45
44
5a
7
51b
12
8

1
35
40
39
37
38
28
27
40a
36
20
29
5a
34
60
4
6
37b
5
7
26
32
52
51
51a
50
49
47
45
46
44
21
12
8

APPARATUS TO CLOSE, STRETCH AND NAIL THE FLANKS OF A SHOE VAMP TO A RESPECTIVE INSOLE, IN PARTICULAR IN MACHINE FOR ASSEMBLING SHOE PARTS

BACKGROUND OF THE INVENTION

1. Field of the Invention

The present invention relates to an apparatus to close, stretch and nail the flanks of a shoe vamp of a respective insole, in particular in machines for assembling shoe parts of the type comprising: a bed; column means operatively mounted to the bed and arranged to rigidly support, in an overturned position, a shoe being worked and comprised of a vamp and an insole engaged on a respective shoe last; two nailing units operatively mounted to the bed at the opposite sides of the column means respectively and each designed to act along one flank of the shoe being worked in order to stretch the vamp towards the insole and fasten the vamp edge to the insole by driving in nails.

2. Prior Art

It is known that is shoe factories automatic machines are used that lend themselves to act along the flanks of a shoe being worked in order to carry out the fastening of the lower vamp edge to the shoe insole, by driving in nails according to a predetermined pitch. To this end these machines are generally comprised of two nailing units operatively mounted to the support bed and respectively located to the opposite sides of column means suitably supporting the shoe being worked in an overturned position, the shoe having been previously fitted on a respective shoe last. Each nailing unit is provided with a nailing hammer which is moved along the corresponding shoe flank following the perimetrical extension of the insole. During the translation, the hammer carries out the driving in of a plurality of nails distributed according to a predetermined pitch, so as to cause the fastening of the lower vamp edge to the insole.

In some recently conceived machines each nailing unit is provided to be associated with stretching members adapted to act on the vamp in front of the hammer in order to stretch the vamp towards the insole. The action of these stretching members aims at ensuring a perfect adjustment of the vamp to the last configuration causing the vamp material in excess to be brought onto the insole where it will be fastened by the next nailing operation.

The machines of the above type have shown problems as regards working speed, practicality in use and qualitative level of the obtained product.

In the connection it is to be noted that in all known machines the shoe being worked has a fixed positioning on the column means, whereas the nailing hammers are caused to move along the shoe itself either in the longitudinal direction or in height or in a transverse direction in order to follow the outline of the perimetrical flank extension as faithfully as possible. The longitudinal translation of hammers takes place upon command of actuators, whereas hammers are moved transversely and in height by means of cams, auxiliary actuators or other devices the operation of which must be adjusted each time depending upon the type of shoe being worked. As adjustments are required, the use of these machines needs the presence of qualified man-power.

In some cases the movement of hammers is provided to be controlled by electronic systems capable of driving the operation of said hammers along the perimetrical flank extension of a shoe in a precise manner. However these electronic systems too need adjustments and/or data to be input by highly qualified staff.

It has also been found that the vamp stretching operation before the hammers and therefore in areas that necessarily are located far away from the nail driving in point, is not an optimum solution for the achievement of a perfect work. The material forming the vamp can in fact exhibit undesired elastic shrinkages at the moment that the action of the stretching members ceases, after the nails have been driven in.

SUMMARY OF THE INVENTION

The main object of the present invention is substantially to eliminate the problems of the known art by providing an apparatus of simplified planning in which the movement of hammers on the perimetrical insole extension is caused by a mechanical sensing system, so that a self-adjustment to the configuration of the shoe being worked takes place and no adjusting intervention is required.

It is another object of the invention to provide an apparatus in which the stretching action on the vamp is carried out exactly in the region where the nail is driven in by the corresponding hammer.

The foregoing and further objects that will become more apparent in the course of the following description are substantially attained by an apparatus for closing, stretching and nailing the vamp flanks of a shoe to a respective insole, in particular in machines for assembling shoe parts, wherein each nailing unit comprises: a nailing hammer arranged to carry out the driving in of nails into the shoe; an end plate supporting the hammer; a movable block oscillatably engaging the end plate about an axis parallel to the longitudinal extension of the shoe; preloading means acting between the end plate and the movable block to urge the hammer downwardly with a predetermined preloading force; a guide structure extending at right angles to the longitudinal extension of the shoe and slidably engaging the movable block; a supporting plate engaging the guide structure in an oscillatable manner about an axis at right angles to the longitudinal extension of the shoe; a transverse-displacement actuator acting on the movable block in order to bring the hammer from a stand-by position in which it is spaced apart sideways from the perimetrical edge of the shoe to a work position in which the lower end of the hammer acts by thrust on the vamp edge folded over the perimetrical edge of the insole in order to stretch the vamp itself; and at least a longitudinal-displacement actuator acting between the machine bed and the column means in order to move the shoe lengthwise according to a predetermined pitch when the hammer of each nailing unit, after a nail has been driven in, goes back to the stand-by position; the guide structure of each nailing unit acting slidably on the shoe from the insole side, in order to transmit to the hammers the variations in height and inclination encountered on the longitudinal extension of the shoe during the shoe translations driven by the longitudinal-displacement actuator.

BRIEF DESCRIPTION OF THE DRAWINGS

Further features and advantages of the invention will best be understood from the detailed description of a preferred embodiment of an apparatus for closing, stretching and nailing the flanks of a shoe vamp to a respective insole, in particular in machines for assembling shoe parts, in accordance with the present invention, given hereinafter by way of non-limiting example with reference to the accompanying drawings, in which:

FIG. 5*a* is a top diagrammatic view of a sensing bar acting on the shoe flank in order to operate the end sequence of the nailing cycle when the plantar arch region on the shoe flank has been reached and passed;

FIG. 8 is a side view relative to the shoe, of a slide member associated with the apparatus in question, disposed in contact relationship on the shoe insole;

FIG. 9 is another side view of the slide member shown in FIG. 8 in a next step of the nailing cycle, during which said member makes the nailing unit take the appropriate angled position to the ends of a perfect vamp nailing, while the shoe is moving in a longitudinal direction;

DESCRIPTION OF THE PREFERRED EMBODIMENT

Figure 1:
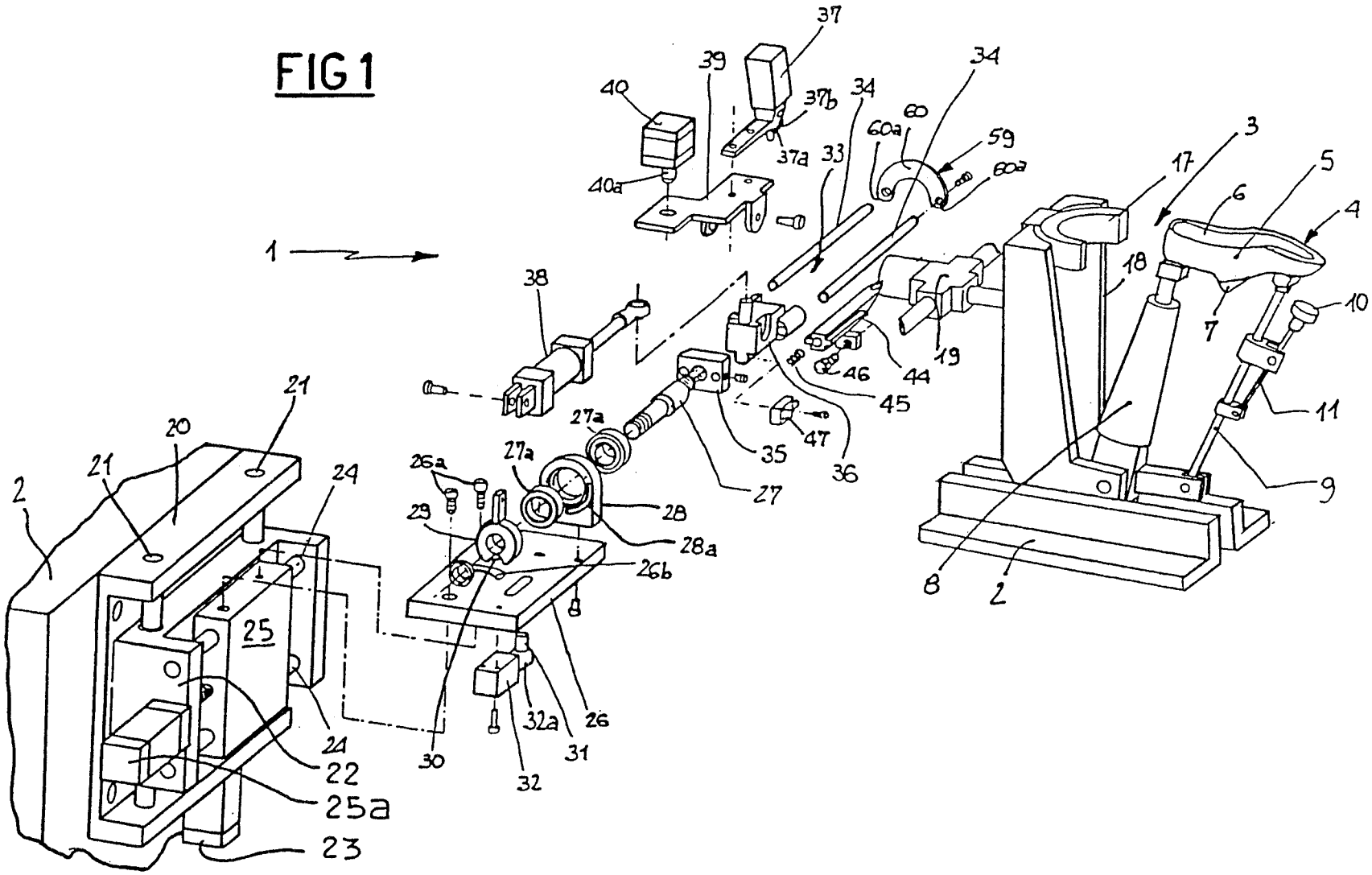
FIG. 1 is an exploded perspective view of the main components of the left nailing unit being part of the apparatus in question, the right nailing unit being identical to and arranged in a mirror image of the one shown.
Figure 2:
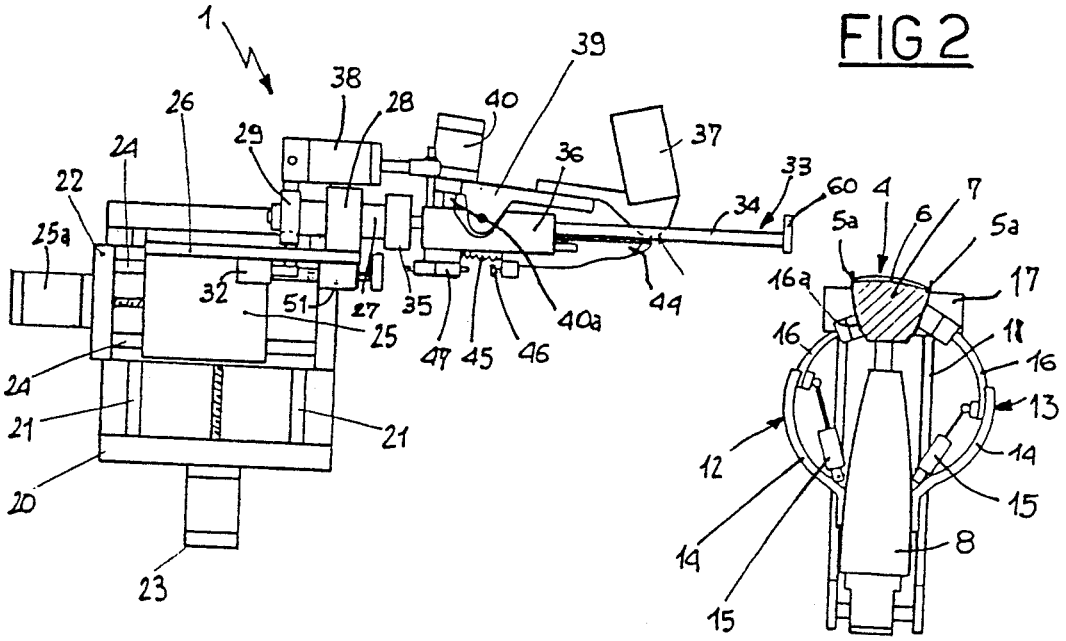
FIG. 2 is a front view relative to the shoe being worked, of the left-hand unit in a rest condition, the shoe being operatively clamped on column means.
Figure 3:
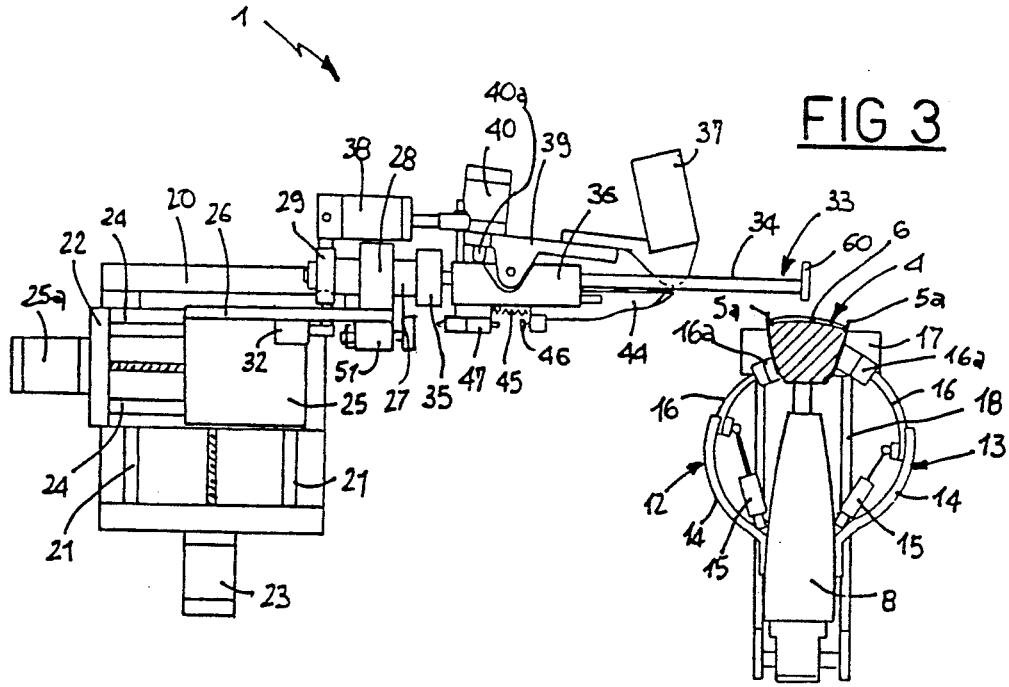
FIG. 3 is a front view still relative to the shoe being worked, of the left-hand nailing unit after it has carried out a first approaching movement in order to reach a work condition on the shoe.

Referring to the drawings, a left-hand nailing unit has been generally identified by reference numeral 1, which unit, associated with another nailing unit identical with and arranged in a mirror image of the preceding one, constitutes the apparatus of the invention.

This apparatus is conventionally associated with a machine for assembling shoe parts, substantially comprising a bed 2 on which a column means 3 is operatively mounted; the column means 3 is adapted to rigidly support, in an overturned position, a shoe being worked 4 essentially consisting of a shoe upper or vamp 5 and an insole fitted on a respective shoe last 7. The column means 3 is essentially comprised of a rear column 8 supporting the last 7 on the heel side and a front column 9 permitting a positioning adjustment and supporting the last 7 on the toe side. In known manner the front column 9 can be moved close to and away from the rear column 8 by an adjusting knob 10 carried by a rod 11 to which a kinematic mechanism, known per se and not shown, connecting it to the rear column, is associated.

Mounting to the rear column 8, on opposite sides thereof, are two clamping groups 12, 13, clamping the vamp 5 against the last 7. These clamping groups have the function of avoiding the extension line of the upper vamp edge being altered at the last neck during the nailing working. To this end each clamping group 12, 13 generally comprises a supporting element 14 fastened to the rear column 8 and provided with T-shaped slide guides. Coupled to the supporting element 14 is a fluid-operated cylinder 15 or technically equivalent means, adapted to move a series of semicircular laminae 16 in a sufficient number to meet reqirements. These laminae are seated and slide in the respective T-shaped slots formed in the supporting element 14 and mutually connected in known manner, for example by screws and springs, so as to be freely movable with respect to one another and simultaneously subjected to the thrust of the fluid-operated actuator 15.

When the actuator 15 is operated, the whole group consisting of laminae 16 will be moved and said laminae will be brought into contact with the shoe so as to lock the vamp 5 to the shoe last 7. In order to improve said clamping action, a band 16*a* elastically adaptable to the last 7 outline can be preferably fastened to the upper ends of laminae 16.

The assembling machine with which the apparatus of the invention is associated further comprises, still in known manner, a die or jaw 17 mounted to a die-carrying group 18 and provided with a closing and opening movement on the shoe heel so that the shoe 4 may be arranged for the next assembling operations. The die 17 is also conventionally provided with members carrying out the stretching and fastening of the vamp edge to the area corresponding to the shoe heel. These members have not been shown in the accompanying figures and will not be further described because they are known and conventional and not of importance to the ends of the invention.

In an original manner, in accordance with the present invention, a longitudinal-displacement actuator 19 acts at the rear of the die-carrying group 18. As more clearly shown in the following, it is adapted to move the shoe 4 according in a step-by-step forward motion in synchronism with the operation of the nailing units. Each nailing unit 1 is made integral with the assembling machine bed 2 through a supporting base 20 fastened to the bed by screws 20*a*. Base 20 is provided with two vertical guide bars 21, mutually parallel, on which a vertical handling carriage is slidably guided. The carriage 22, controlled in its displacements by a vertical-displacement fluid-operated actuator 24, in turn carries a pair of horizontal guide bars 24 slidably engaging a horizontal-displacement carriage 25 controlled by a respective horizontal-displacement actuator 25*a*.

Fastented to the horizontal-displacement carriage 25 by screws 26*a* is a supporting plate 26 designed to operatively support the members that will carry out workings on the shoe 4. Preferably at least one of the screws 26*a* crosses the plate 26 in the region of an elongated curved hole 26*b*. This solution will enable the angular adjustment of the entry direction of the nailing unit relative to the shoe being worked, so that the starting point of the line of nails in succession on the shoe side can be established in a precise manner depending upon the type of shoe being worked (for children, men and so on).

The members designed to act on the shoe 4 are oscillatably connected to the supporting plate 26 by a connecting shaft 27 that, through the interposition of bearings 27*a*, is rotatably engaged according to an axis substantially at right angles to the longitudinal extension of the shoe, with a supporting collar 28 fastened to the plate itself. From the foregoing it will be apparent that all components connected to the shaft 27, to be described in the following, will have the possibility of carrying out a swinging movement about the rotational axis of the shaft in order to adjust themselves to the variations in inclination encountered along the longitudinal extension of the shoe.

Also provided at one end of the connecting shaft 27 is an annular support 29 connected to the shaft itself and provided with a wedge-shaped cavity 30 into which a dowel pin 31 carried by the rod 32*a* of a fluid-operated centering cylinder fastened to the supporting plate 26 is detachably insertable.

When the nailing unit 1 is at rest, the centering cylinder 32 keeps the dowel pin 31 within the cavity 30, so that the connecting shaft 27 and the members linked thereto may maintain a predetermined fixed orientation. As soon as the work cycle of the nailing unit 1 begins, the centering cylinder 32 draws the dowel pin 31 out of the cavity 30 thereby releasing the connecting shaft 27 that can rotate about its own axis so as to enable the nailing unit to adjust itself to the shoe 4 outline.

Fastened to the connecting shaft 27 is a guide structure 33 comprising two rods 34 parallel to the rotational axis of the shaft and connected thereto by a fixed block 35. The guide rods 34 slidably engage a movable block 36 carrying a nailing hammer 37. The block 36 is submitted to the action of a transverse-displacement actuator 38 connected to the tongue 29*a* projecting from teh annular support 29 and acting so as to move the nailing hammer 37 from a stand-by position (FIG. 4) in which it is spaced apart sideways from the perimetrical shoe 4 edge, to a work position (FIGS. 5, 6) in which the lower end 37*a* of the hammer acts by thrust on the vamp edge 5*a* folded over the perimetrical edge of the insole 6 so as to exert a stretching action on the vamp.

In greater detail, the nailing hammer 37 is connected to the movable block 36 after interposing an end plate 39 therebetween which is hinged to the block by two pivot pins 39*a* engaging it in an oscillatable manner about an axis substantially parallel to the longitudinal extension of the shoe 4. Also mounted to the end plate 39, along with further members known per se and therefore not shown, adapted to supply the hammer 37 with nails, is a preloading means consisting of a pneumatic cylinder 40 acting by its rod 40*a* on the movable block 36 for urging the lower hammer end 37*a* downwardly imparting a predetermined adjustable preloading force to it. In this way, when the lower hammer end is brought to a working position, it will be obliged to move up along the shoe edge causing the rotation of the end plate 39 about the pivots 39*a* against the action of the cylinder 40. The combined thrust and translation action transmitted to the lower hammer end 37*a* will therefore cause the stretching of the shoe vamp towards the inner part of the insole 6. In order to ensure a perfect adhesion of the lower hammer end 37*a* to the vamp edge 5*a*, a friction element is applied to said end 37*a*, which friction element is made of elastomeric material or at all events of a material capable of easy adaptation to the last sides and of exerting a stretching action on the vamp without running the risk of damaging the material of which it is made.

Preferably the hammer 37 should be connected to the end plate 39 by threaded elements carrying at least an adjustment knob 41 through which the initial positioning in height of the lower hammer end 37*a* can be adjusted.

Figure 10:
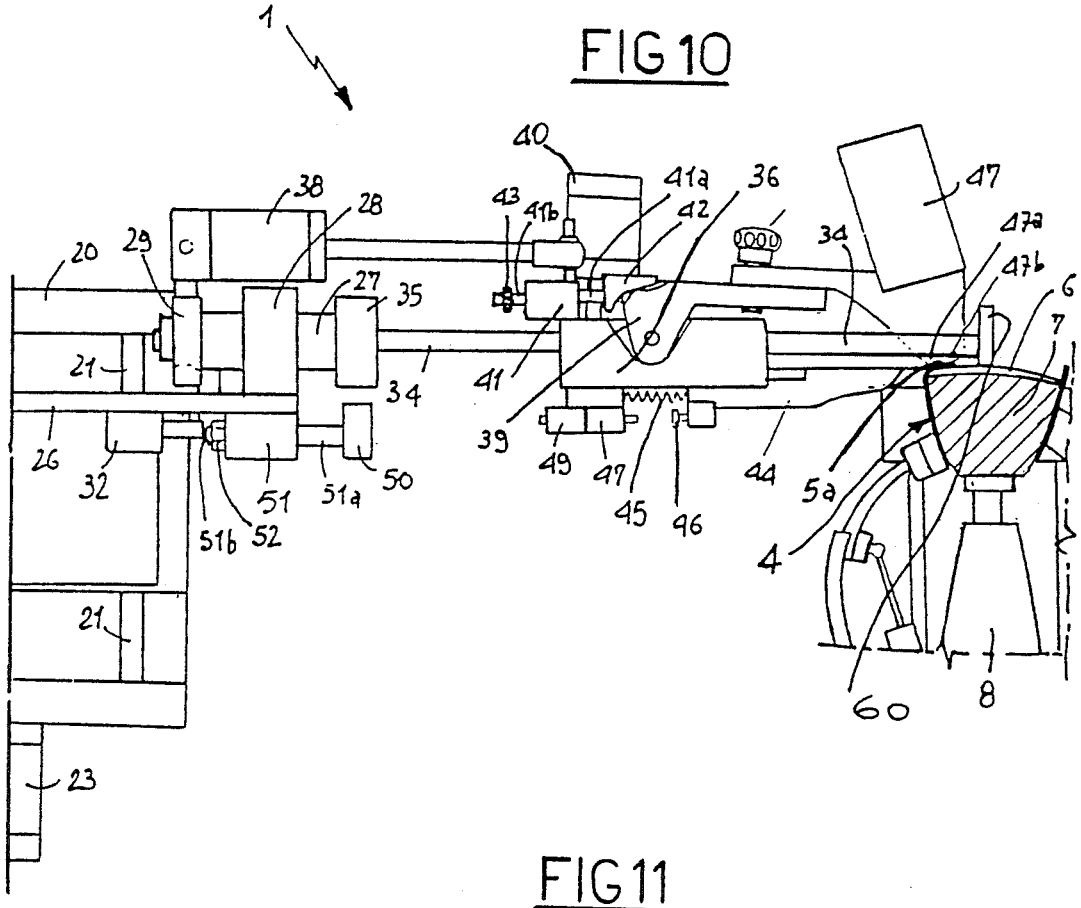
FIG. 10 shows a detail of the left-hand nailing unit in accordance with an alternative embodiment of the apparatus in question, where a compensating actuator is provided for modifying the positioning in height of the hammer when the plantar arch region on the inner flank of the shoe being worked has been passed.

Referring particularly to FIG. 10, for best results in the stretching work on the vamp flanks a fluid-operated compensating actuator 41 may be also provided and it has the function of automatically adapting the hammer height depending upon the fact that the shoe 4 being worked is a right or left shoe. It is in fact known that the side edges of a shoe have different heights at the outer and inner sides, above all in the plantar arch region.

The intervention of the conpensating actuator 41 is selectively controlled by a known microswitch (not shown), associated with the front column 9 in order to detect whether the shoe being worked is a left or right shoe. Depending upon the detection, the compensating actuator 41 belonging to one or the other nailing unit will intervene.

The compensating actuator 41 is fastened to the movable block 36 and is provided, on its rod 41*a*, with a wedge-shaped element 42 that, as a result of a longitudinal displacement, will contact an edge of the end plate 39. The stroke of the wedge-shaped element 42 and therefore the displacement range of the hammer 37 resulting from the operation of the compensating actuator 41 can be adjusted by means of a ring nut 43 screwed on to the extension 41*b* of the rod 41*a* and projecting rearwardly from the actuator itself.

Figure 5:
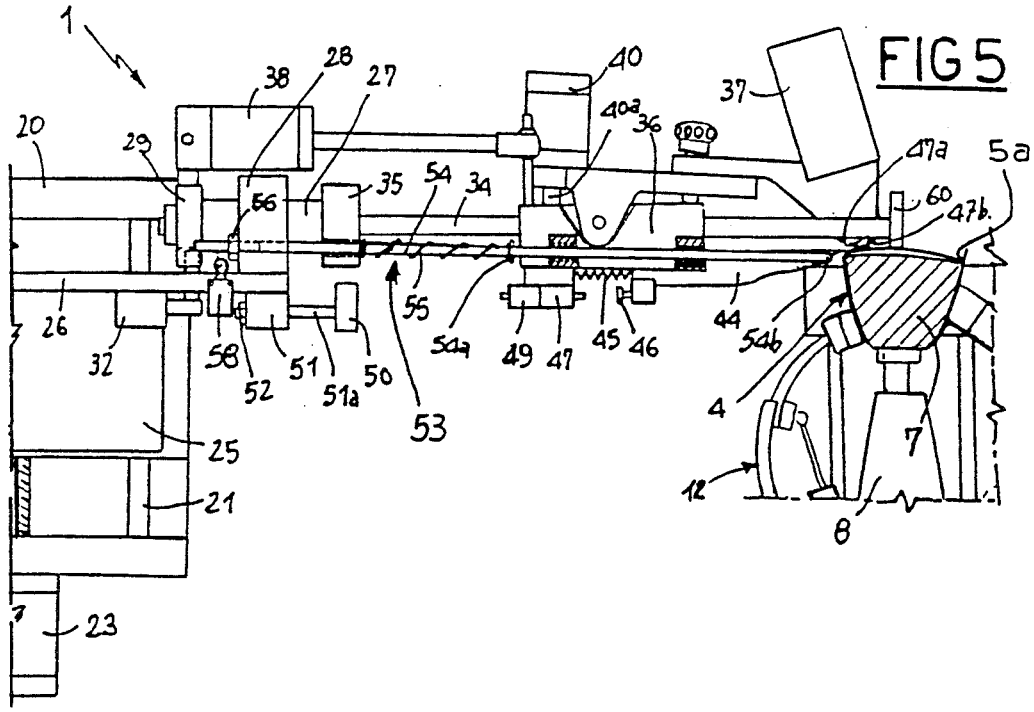
FIG. 5 shows the nailing unit during the vamp-stretching step, that is when the lower hammer end is dragging along the vamp edge towards the inner side of the insole.
Figure 6:
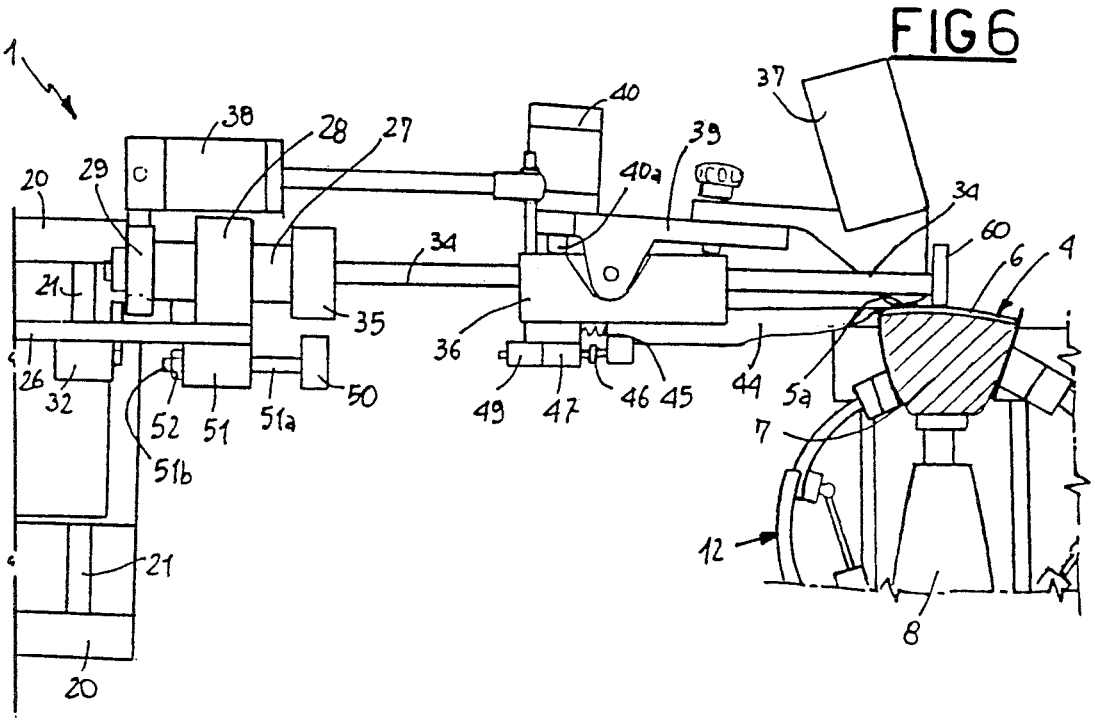
FIG. 6 shows the nailing unit in a final step of the nailing cycle, that is when the driving in of the nail for fastening the vamp to the insole is operated.
Figure 7:
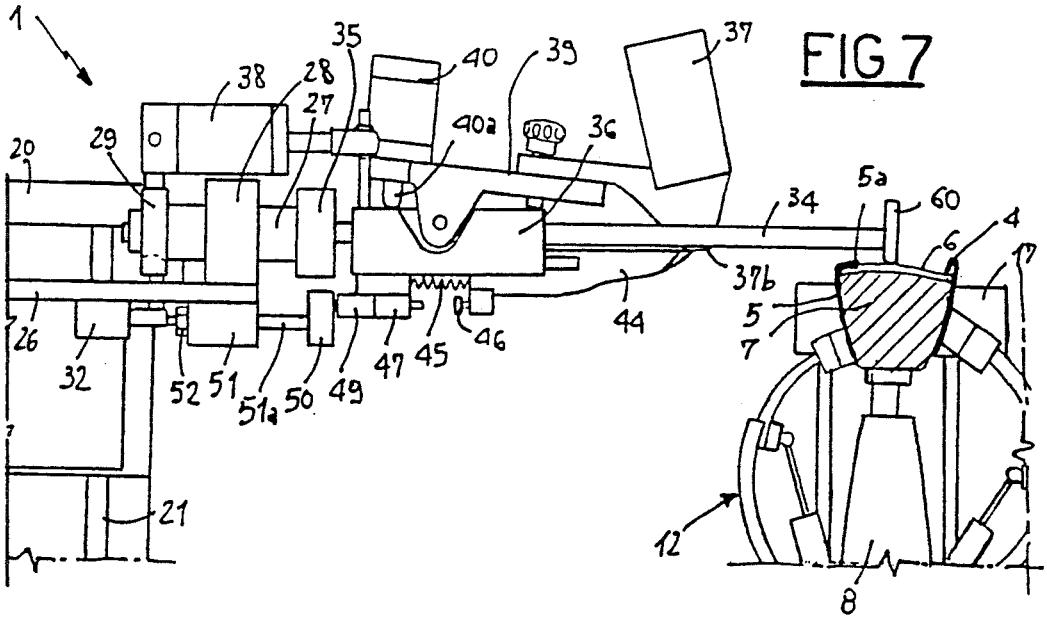
FIG. 7 shows the nailing unit when the respective nailing hammer is in the return position.

The nailing unit 1 further comprises a mechanical sensing finger 44 slidably guided in a direction parallel to the guide rods 34, within a housing formed in the movable block 36 and subjected to the action of a counter spring 45 tending to move it away from the block itself. The sensing finger 44 is designed to contact the shoe flank when the movable block 36 moves along the rods 34 during the displacement of the hammer 37 from the rest position to the operating position (FIG. 5). Once in contact with the shoe 4, the sensing finger 44 will undergo a backward movement in the block 36 due to the transverse movement carried out by the block itself being acted upon by the actuator 38, against the action of spring 45. An adjustable pin 46 screwed down at the rear of the sensing finger 44 will contact a first microswitch 47 fastened under the movable block 36. This microswitch will cause the stoppage of the longitudinal-displacement actuator and the subsequent driving in of a nail into the shoe 4 by hammer 37. After this operation the hammer 37 will go back to the rest position and simultaneously the longitudinal-displacement actuator 19 will be operated in order to move the shoe 4 lengthwise according to a predetermined pitch.

By acting on the adjustable pin 46 the distance between the nail driving in point and the corresponding shoe edge can be modified.

Mounted under the movable block 36 is a second microswitch 49 facing away from the first microswitch 47, and associated with this second microswitch 49 is a movable locator 50 mounted on the rod 51*a* of a fluid-operated cylinder 51 fastened to the lower part of the supporting plate 26.

While the hammer 37 is moving close to the shoe 4, there is the activation of the cylinder 51, slightly delayed relative to the start of the transverse-displacement actuator 38. The cylinder 51 will bring the movable locator 50 from a rest position in which it is spaced apart from the movable block 36 (FIG. 4) to an operating position in which it is located close to the block so as to activate the second microswitch 49 when the hammer 37 is about to be brought back to the idle position.

Upon the operation of the second microswitch 49 the block 36 will reverse its motion and the hammer 37 as well, by effect of actuator 38, and therefore a new stroke taking the hammer again to its work position will begin.

Therefore, by the alternate action of the first and second microswitches, 47 and 49, the hammer 37 will carry out a repeated sequence of reciprocating strokes during which nails are driven in, the actuator 19 performing meanwhile, in register therewith, the longitudinal displacement of the shoe 4 according to a predetermined pitch. This operating sequence will last until stopping means, to be described in the following, intervene. At this point the actuator 51 will take the movable locator 50 back to the rest position, so that the transverse-displacement actuator 38 will be able to take the hammer back to the stand-by position without the occurrence of the microswitch 49 operation.

Preferably also the cylinder 51 should be provided with an adjusting ring nut 52 screwed on to the extension 51*b* of the rod 51*a*. By acting on the ring nut 52 it is possible to modify the positioning of the movable locator 50 at the operating position for suitably adjusting the amplitude and duration of the strokes carried out by the movable block 36.

Figure 4:
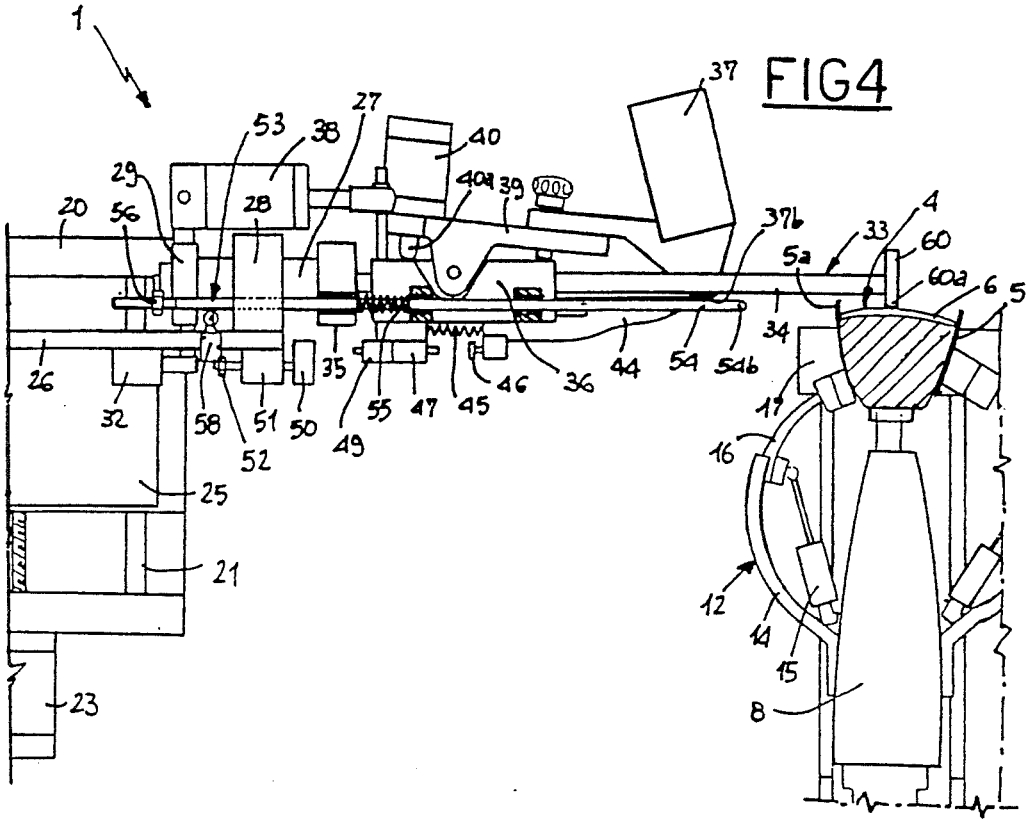
FIG. 4 shows the above nailing unit in a starting condition of a nailing cycle.

Still in accordance with the present invention, said stopping means generally identified at 53 in FIGS. 4, 5 and 5*a*, should preferably comprise a sensing bar 54 slidably passing through the movable block 36 and disposed in side by side relation with the front of the sensing finger 44. The sensing bar 54 is constantly urged towards the shoe 4 upon the action of a spring 55 acting between the fixed block 35 and a shoulder 54*a* formed on the bar itself.

The sensing bar 54 projects from the rear part of the movable block 36 slidably passing through the fixed block 35 and the supporting collar 28 in the region of an elongated hole 28*a* formed in the collar concentrically with the axis of the connecting shaft 27. Screwed on to the rear end of the sensing bar 54 is a stopping nut 56 designed to abut against the supporting collar 28 to stop the forward movement of the bar when the front end 54*b* thereof is slightly spaced apart from the corresponding shoe flank. In this manner the bar 54 is arranged to slightly move backward when the shoe, following its progressive longitudinal movement, contacts the front end 54*b* of the bar itself. This contact will take place at the flank area, denoted by 57 in FIG. 5*a*, disposed at the front of the plantar arch region.

Upon the backward movement of the sensing bar 54, the microswitch 58 will be activated by the nut 56. This microswitch 58 will command, eventually after a predetermined time, the backward movement of the movable locator 50, the nailing cycle being thereby finished. Optionally the microswitch 58 could also control the intervening of the compensating actuator 41.

The stopping nut 56 lends itself to be adjusted in its positioning on the rear end of the sensing bar 54 depending upon the working in progress and the particular requirements.

In addition, in accordance with the present invention, the guide structure 33 of each nailing unit 1 slidably acts on the shoe 4, from the insole 6 side, in order to transmit to the hammers 37 the variations in height and inclination encountered on the longitudinal extension of the shoe, while the shoe is being moved by the longitudinal-displacement actuator 19. In the embodiment shown in FIGS. 1 to 9 the guide structure 33 is provided for the purpose with a slide member 59 which is accomplished by applying a U-shaped plate 60 to the front ends of the guide bars 34 of the corresponding nailing unit. The U-shaped plate 60 has rounded ends 60*a* adapted to come into contact with the insole 6 exerting a downwardly oriented thrust force thereon, said force being preset and adjusted by the vertical-displacement actuator 23. As can be seen from FIGS. 8 and 9, the U-shaped plate 60 can modify its positioning in height and its orientation so as to perfectly follow the surface extension of the insole 6. The U-shaped plate 60 variations as regards its positioning and orientation are directly transmitted, through the guide structures 33 and the members mounted thereon, to the corresponding hammer 37.

It is to be noted that the presence of the slide member 59 on the guide structure 33 is not determinant to the ends of the invention. In fact, in the absence of this slide member the free ends of the guide bars 34 can be directly brought to a position in which they slidably rest on the shoe 4 being worked for performing the same functions as described with reference to the U-shaped plate 60. In this case the front guide bar 34 may also have the task of taking up the material constituting the vamp 5.

Figure 11:
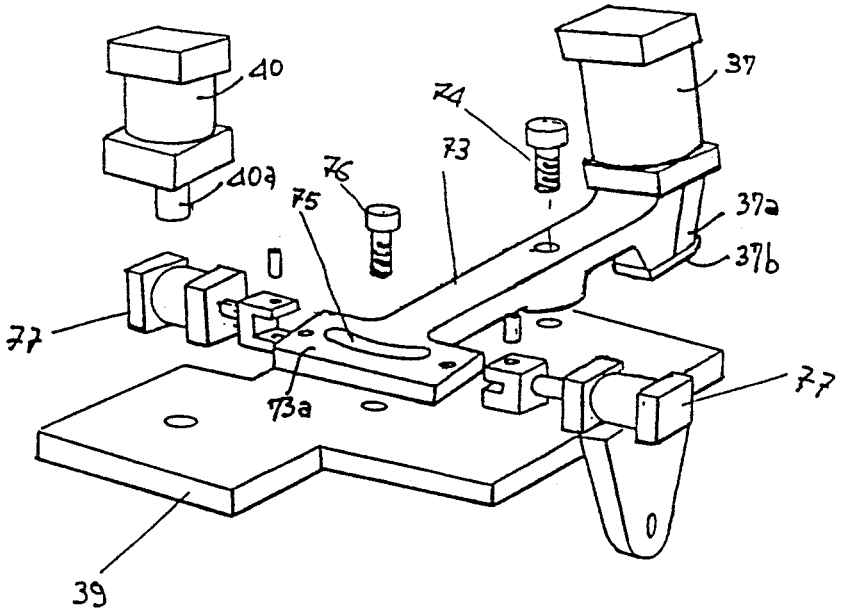
FIG. 11 is an exploded perspective view showing a detail of the nailing unit in accordance with a still further alternative embodiment of the invention, in which members adapted to move the hammer sideways are provided in order to achieve the smoothing of the vamp edge on the insole.

Shown in FIG. 11 is an alternative embodiment of the technical solution adopted for engaging the hammer 37 of each nailing unit 1 to the respective end plate 39. In accordance with this alternative solution, during the nailing step the hammer 37 acting by thrust on the vamp edge 5*a* is provided to carry out a swinging motion in a horizontal plane in order to smooth said vamp edge on the insole 6.

To this end, the hammer 37 is connected to the plate 39 by an arm 73 oscillatably connected to the plate by a vertical pin 74. The arm 73 has an end portion 73*a* provided with a curved elongated hole 75 extending concentrically with the axis of the pin 74 and slidably guided on a peg 76 fastened to the end plate 39. Acting on the end portion 73*a* of arm 73 according to opposite directions are two fluid-operated smoothing cylinders 77 fastened to the plate 39. The smoothing cylinders 77 will be individually and selectively operated when the lower end 37*a* of hammer 37 comes into contact with the vamp edge 5*a*. In this situation, the lower end 37*a* of hammer 37 will still perform a vamp stretching function, with the difference that when the sensing finger 44 hits the shoe 4 thereby causing the operation of the microswitch 47, also the intervening of one of the cylinders 77 will occur, which will bring about a translation of the lower hammer ends 37*a* on the previously stretched vamp edge. The displacement of the lower end 37*a* lengthwise will smooth the material forming the vamp towards the inner part of the insole, thereby eliminating possible wrinkles or other irregularities.

After this smoothing action the nail will be driven in by hammer 37.

For the sake of clarity, the whole work cycle of the shoe assembling machine on which the apparatus of the invention is installed will be hereinafter summarized.

The shoe 4 being worked is engaged on the column means 3 and subsequently urged into the die 17. Under this situation the positioning in height of the shoe is automatically defined in a known and conventional manner and also the clamping of the vamp 5 to the shoe last 7 is carried out by the clamping members associated with the column means 3. Still in known manner, upon the action of members acting through the edge die 17 the nailing of the vamp edge in the region of the heel is carried out and afterwards the column means, together with the shoe 4 clamped thereon and the die itself, is instantaneously pushed forward by the longitudinal-displacement actuator 19.

At this point each nailing unit is moved close to the shoe 4 upon the action of the horizontal-displacement actuators 25*a*. Subsequently the vertical-displacement actuators 23 are operated in order to cause the lowering of the nailing units as far as the slide members 59 are in thrust relationship with the insole 6.

Then the longitudinal-displacement actuator 19 is operated again, in order to cause the backward movement of the shoe 4 under the slide members 59. Upon command of a timer the transverse-displacement actuator 38 of each nailing unit 1 is operated so that the hammer 37 is brought to its operating position thereby causing the vamp stretching by means of the friction element 37*b* applied to the lower hammer end 37*a*. Meanwhile the cylinder 51 is operated as well, and it will bring the movable locator 50 from the rest position to the operating position.

When the sensing finger 44 hits the shoe 4 the first microswitch 47 causes the longitudinal-displacement actuator 19 and transverse-displacement actuator 38 to be stopped and nail to be driven in by hammer 37, preferably after the intervention of one of the smoothing cylinders 77. When the nail driving in is over, the transverse-displacement cylinder 38 is actuated again in order to move the hammer 37 away from the shoe 4. Also the longitudinal backward displacement of the shoe 4 is restored upon command of actuator 19. When the second microswitch 49 comes in contact with the movable locator 50, the next stretching and nailing step is started by a new advancing of hammer 37 towards the shoe 4. The stretching and nailing steps follow each other as far as the sensing rod 54 comes in contact with the shoe 4 flank and causes the backward movement of the movable locator 50 to the rest position and the return of all members of the shoe-assembling machine to the starting condition.

The present invention attains the intended purposes.

Obviously the invention as conceived is susceptible of many modifications and variations, all of them falling within the scope of the invention idea.

What is claimed is:

1. An apparatus to close, stretch and nail the flanks of a shoe vamp to a respective insole, in particular in machines for assembling shoe parts, comprising:

a bed;

column means operatively mounted to the bed and arranged to rigidly support, in an overturned position, a shoe being worked comprised of a vamp and an insole fitted on a respective shoe last;

two nailing units operatively mounted to the bed on the opposite sides of the column means respectively, and each arranged to act along a flank of the shoe being worked in order to stretch the vamp on the insole and fasten the vamp edge to the insole through the driving in of nails, wherein each nailing unit comprises:

a nailing hammer designed to carry out the driving in of nails into the shoe;

an end plate supporting the hammer;

a movable block engaging the plate in an oscillatable manner about an axis parallel to the longitudinal extension of the shoe;

preloading means acting between the end plate and the movable block in order to urge the hammer downwardly according to a predetermined preloading force;

a guide structure extending at right angles to the longitudinal extension of the shoe and slidably engaging the movable block;

a supporting plate engaging the guide structure in an oscillatable manner about an axis perpendicular to the longitudinal extension of the shoe;

a transverse-displacement actuator acting on the movable block to bring hammer from a stand-by position in which it is moved apart sideways from the perimetrical edge of the shoe to a work position in which the lower hammer end acts in thrust relation on the vamp edge folded over the perimetrical edge of the insole in order to stretch the vamp; and at least a longitudinal-displacement actuator acting between the bed and the column means to move the shoe lengthwise according to a predetermined pitch when the hammer of each nailing unit, after having driven in a nail, comes back to the stand-by position; the guide structure of each nailing unit slidably acting on the shoe on the side of the insole, in order to transmit to the hammers the variations in height and inclination encountered on the longitudinal shoe extension during the translation of said shoe upon the action of the longitudinal-displacement actuator.

2. The apparatus as claimed in claim 1, wherein each nailing unit further comprises a mechanical sensing finger slidably supported by the movable block and arranged to come into contact with the shoe flank when the hammer reaches the operating position; in order to activate a microswitch causing the stoppage of the longitudinal-displacement actuator and the subsequent driving in of a nail into the shoe by the hammer.

3. The apparatus as claimed in claim 1, wherein associated with the movable block is a second microswitch operable by a movable locator so as to cause, upon the action of the transverse-displacement actuator, the translation of the nailing hammer from the stand-by position to the operating position.

4. The apparatus as claimed in claim 3, wherein said movable locator is mounted to the rod of a fluid-operated cylinder designed to move the actuator from a rest position in which it is spaced apart from the movable block, to an operating position in which it is located close to the block in order to activate the second microswitch when the nailing hammer is about to be taken back to the stand-by position, stopping means being provided for controlling the return of the movable locator to the rest position when the nailing cycle along the shoe flank is about to finish.

5. The apparatus as claimed in claim 4. wherein said stopping means comprises: a sensing bar slidably engaged through the movable block and the guide structure; a spring acting between the guide structure and said sensing bar in order to constantly urge said bar towards the shoe being worked; a stop nut screwed on to the sensing bar and arranged to act in abutment on the guide structure for stopping the advancing of said bar under the action of the spring when the front end of said bar is located a predetermined distance from the shoe flank; and a microswitch designed to be operated by the stop nut to cause the return of the movable locator to the rest position when the shoe moved by the longitudinal-displacement actuator hits and moves the sensing bar axially.

6. The apparatus as claimed in claim 1, wherein said preloading means comprises at least a pnueumatic cylinder mounted to the end plate and acting by its rod on the movable block.

7. The apparatus as claimed in claim 1, wherein said supporting plate is fastened to a horizontal-displacement carriage movable on a vertical-displacement carriage in turn slidably engaged by a supporting base fastened to the bed, said displacement carriage being movable in a horizontal and vertical direction respectively upon command of respective fluid-operated actuators.

8. The apparatus as claimed in claim 1, wherein said guide structure comprises a pair of parallel guide rods slidably engaging said movable block and extending from a fixed block integral with a connecting shaft which is rotatably engaged through a supporting collar fastened to the supporting plate.

9. The apparatus as claimed in claim 8, wherein each nailing unit comprises: an annular support fastened to said connecting shaft and provided with a wedge-shaped cavity; and a fluid-operated centering cylinder fastened to the supporting plate and carrying a dowel pin on its rod, which pin is removably insertable in said wedge-shaped cavity in order to give a predetermined orientation to the guide structure and the members supported by the latter.

10. The apparatus as claimed in claim 1. wherein the guide structure acts on the shoe being worked through a slide member comprising a U-shaped plate fastened to the guide structure and having rounded edges desinged to come into sliding contact with the shoe insole, exerting a predetermined downwardly-oriented thrust thereon.

11. The apparatus as claimed in claim 1, wherein each nailing unit further comprises a fluid-operated compensating actuator acting between the movable block and the end plate for automatically adapting the hammer height depending upon whether the shoe being worked is of the right or left type.

12. The apparatus as claimed in claim 11, wherein the compensating actuator is fastened to the movable block and is provided, on its rod, with a wedge-shaped element designed to come into contact with an edge of the end plate in order to modify the positioning in height of the hammer following a longitudinal displacement of the wedge-shaped element upon the action of said compensating actuator.

13. The apparatus as claimed in claim 12, wherein the rod the compensating actuator has an extension projecting from the rear part of said actuator and operatively engaging a ring nut for the adjustment of the wedge-shaped element stroke.

14. The apparatus as claimed in claim 1, wherein the nailing hammer acts on the shoe being worked by a friction element made of elastomeric material applied to the lower hammer end.

15. The apparatus as claimed in claim 1, wherein said nailing hammer is carried by an arm oscillatably linked to the end plate and is submitted to the selective action of two fluid-operated smoothing cylinders fastened to said plate and acting in opposite directions on said arm in order to cause a longitudinal translation of the lower hammer end on the shoe vamp when the hammer reaches the operating position.

* * * * *